US008939549B2

(12) United States Patent
Kang et al.

(10) Patent No.: US 8,939,549 B2
(45) Date of Patent: Jan. 27, 2015

(54) INKJET PRINTING APPARATUSES, INKJET NOZZLES, AND METHODS OF FORMING INKJET NOZZLES

(71) Applicant: Samsung Electronics Co., Ltd., Suwon-Si, Gyeonggi-Do (KR)

(72) Inventors: Sung-gyu Kang, Suwon-si (KR); Young-ki Hong, Anyang-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 14/084,776

(22) Filed: Nov. 20, 2013

(65) Prior Publication Data

US 2014/0160203 A1 Jun. 12, 2014

(30) Foreign Application Priority Data

Dec. 6, 2012 (KR) ..... 10-2012-0141180

(51) Int. Cl.
*B41J 2/16* (2006.01)
*B41J 2/14* (2006.01)

(52) U.S. Cl.
CPC *B41J 2/14* (2013.01); *B41J 2/1433* (2013.01); *B41J 2/162* (2013.01); *B41J 2/1628* (2013.01); *B41J 2/1629* (2013.01); *B41J 2002/14411* (2013.01); *B41J 2002/14443* (2013.01); *B41J 2002/14475* (2013.01)
USPC ..... 347/47

(58) Field of Classification Search
CPC ..... B41J 2/1433; B41J 2/1628; B41J 2/1631; B41J 2/162; B41J 2/1623
See application file for complete search history.

(56) References Cited

U.S. PATENT DOCUMENTS

| | | | | |
|---|---|---|---|---|
| 4,169,008 | A | 9/1979 | Kurth | |
| 4,282,533 | A | 8/1981 | Brooks et al. | |
| 5,646,662 | A | 7/1997 | Kitahara | |
| 7,066,581 | B2 | 6/2006 | Conta et al. | |
| 2001/0024219 | A1 | 9/2001 | Kanda et al. | |
| 2005/0110835 | A1* | 5/2005 | Ito et al. | 347/47 |
| 2007/0148567 | A1 | 6/2007 | Ferber et al. | |
| 2008/0000086 | A1 | 1/2008 | Ito et al. | |
| 2010/0331769 | A1 | 12/2010 | Nisato et al. | |
| 2011/0132872 | A1 | 6/2011 | Van De Sande et al. | |
| 2012/0120153 | A1 | 5/2012 | Kang | |

FOREIGN PATENT DOCUMENTS

| | | | |
|---|---|---|---|
| EP | 0519279 | A2 | 12/1992 |
| EP | 1138499 | A2 | 10/2001 |
| EP | 1520703 | A1 | 4/2005 |
| JP | 2012011566 | A | 1/2012 |
| KR | 20060081110 | A | 7/2006 |
| KR | 20090037119 | | 4/2009 |
| WO | WO-2008/050287 | A1 | 5/2008 |

OTHER PUBLICATIONS

European Search Report dated Feb. 14, 2014 for corresponding European Application No. 13196070.

* cited by examiner

*Primary Examiner* — Lisa M Solomon
(74) *Attorney, Agent, or Firm* — Harness, Dickey & Pierce, P.L.C.

(57) ABSTRACT

Provided is an inkjet printing apparatus. The inkjet printing apparatus includes a nozzle. The nozzle includes at least two nozzle parts. A first of the at least two nozzle parts has a first tapered shape, and a second of the at least two nozzle parts has a second tapered shape and extends from the first nozzle part. The first and second tapered shapes have a same taper direction.

19 Claims, 14 Drawing Sheets

INKJET PRINTING APPARATUSES, INKJET NOZZLES, AND METHODS OF FORMING INKJET NOZZLES

CROSS-REFERENCE TO RELATED APPLICATIONS

This application claims the benefit of Korean Patent Application No. 10-2012-0141180, filed on Dec. 6, 2012, in the Korean Intellectual Property Office, the disclosure of which is incorporated herein in its entirety by reference.

BACKGROUND

1. Field

At least one example embodiment relates to inkjet printing apparatuses and/or methods of forming nozzles, and more particularly, to inkjet printing apparatuses ejecting ink droplets via minute nozzles and/or methods of forming the nozzles.

2. Description of the Related Art

Inkjet printing apparatuses print a predetermined image by ejecting minute droplets of ink on desired areas of a printing medium.

An inkjet printing apparatus may be classified as a piezoelectric-type inkjet printing apparatus and/or an electrostatic-type inkjet printing apparatus according to an ink ejecting method. A piezoelectric-type inkjet printing apparatus ejects ink via piezoelectric deformation, and an electrostatic-type inkjet printing apparatus ejects ink via an electrostatic force. An electrostatic-type inkjet printing apparatus may use a method of ejecting ink droplets by electrostatic induction or a method of ejecting ink droplets after accumulating charged pigments via an electrostatic force.

Inkjet technology is applied to various fields including traditional graphic printing to the industrial printable electronics, displays, biotechnology, bioscience, etc. This expanding use of inkjet technology results from direct patterning properties of the inkjet technology. Compared with a photolithographic process, which is performed several times for forming a desired pattern, when using the inkjet technology, the pattern may be formed by fewer steps, or further, by one step, thereby reducing expenses. Also, when using the inkjet technology to manufacture electronic circuits, it is possible to use non-planar or flexible substrates, which are not easily used in photolithography.

As described above, applying inkjet technology to the display field or printing electronic engineering field may allow superfine high resolution printing. In these fields, it is desirable to provide nozzles whose diameters are several micrometers or less to eject minute droplets of several picoliters to several femtoliters.

SUMMARY

At least one example embodiment provides inkjet printing apparatuses capable of ejecting uniform minute droplets, inkjet nozzles whose apertures have a uniform shape and a uniform diameter, and/or methods of forming inkjet nozzles.

Additional aspects will be set forth in part in the description which follows and, in part, will be apparent from the description, or may be learned by practice of example embodiments.

According to at least one example embodiment, an inkjet printing apparatus includes a nozzle. The nozzle includes at least two nozzle parts. A first of the at least two nozzle parts has a first tapered shape, and a second of the at least two nozzle parts has a second tapered shape and extends from the first nozzle part. The first and second tapered shapes have a same taper direction.

According to at least one example embodiment, the second nozzle part has a tapered shape to a direction in which the nozzle extends, and the taper angle of the second nozzle part is greater than zero and less than 90 degrees.

According to at least one example embodiment, the at least two nozzle parts includes a third nozzle part having a third tapered shape and extending from the second nozzle part, and a taper angle of the second nozzle part is less than taper angles of the first nozzle part and the third nozzle part.

According to at least one example embodiment, the at least two nozzle parts includes a third nozzle part having a third tapered shape and extending from the second nozzle part, and taper angles of the first nozzle part and the third nozzles part are substantially the same.

According to at least one example embodiment, the inkjet apparatus further includes a trench formed around the nozzle.

According to at least one example embodiment, the at least two nozzle parts are in a single substrate.

According to at least one example embodiment, the trench extends in a first direction and is formed on two sides of the nozzle in a second direction substantially orthogonal to the first direction.

According to at least one example embodiment, wherein the nozzle is a polypyramid shape.

According to at least one example embodiment, the inkjet apparatus further includes an actuator. The actuator includes a piezoelectric actuator or an electrostatic actuator configured to provide a driving force to eject ink onto a printing medium.

According to at least one example embodiment, a method of forming a nozzle of an inkjet printing apparatus includes forming a first depression from a first surface of a substrate, the first depression being tapered. The method includes forming an outlet from a second surface of the substrate opposite to the first surface, the outlet being connected to an apex of the first depression. The method also includes forming second depression, the second depression being formed in the outlet and having a taper angle different from a taper angle of the first depression.

According to at least one example embodiment, the forming the first depression and a second depression includes a wet etching process.

According to at least one example embodiment, the forming an outlet includes a dry etching process.

According to at least one example embodiment, the substrate is a single crystal substrate, and the wet etching process is an anisotropic wet etching process.

According to at least one example embodiment, the method further includes forming an actuator. The actuator is configured to provide a driving force to eject ink onto a printing medium the substrate is a single crystal silicon substrate.

According to at least one example embodiment, the first depression, the second depression, and the third depression are formed to have a quadrangular pyramid shape.

According to at least one example embodiment, the method further includes forming a third depression. The third depression is formed in the second depression and has a taper angle different from the taper angle of the second depression. The taper angle of the second depression is less than the taper angles of the first depression and the third depression.

According to at least one example embodiment, the method further includes forming a third depression. The third depression is formed in the second depression and having a taper angle different from the taper angle of the second depression. The taper angles of the first depression and the third depression are substantially the same.

According to at least one example embodiment, the method further includes forming a trench around the third depression, the trench being formed in the second surface of the substrate such that the second surface is depressed toward the first surface.

According to at least one example embodiment, the trench is formed around an entirety of the nozzle.

According to at least one example embodiment, the trench extends in a first direction and is formed on two sides of the nozzle in a second direction substantially orthogonal to the first direction.

BRIEF DESCRIPTION OF THE DRAWINGS

These and/or other aspects will become apparent and more readily appreciated from the following description of example embodiments, taken in conjunction with the accompanying drawings in which.

DETAILED DESCRIPTION OF EXAMPLE EMBODIMENTS

Figure 1:
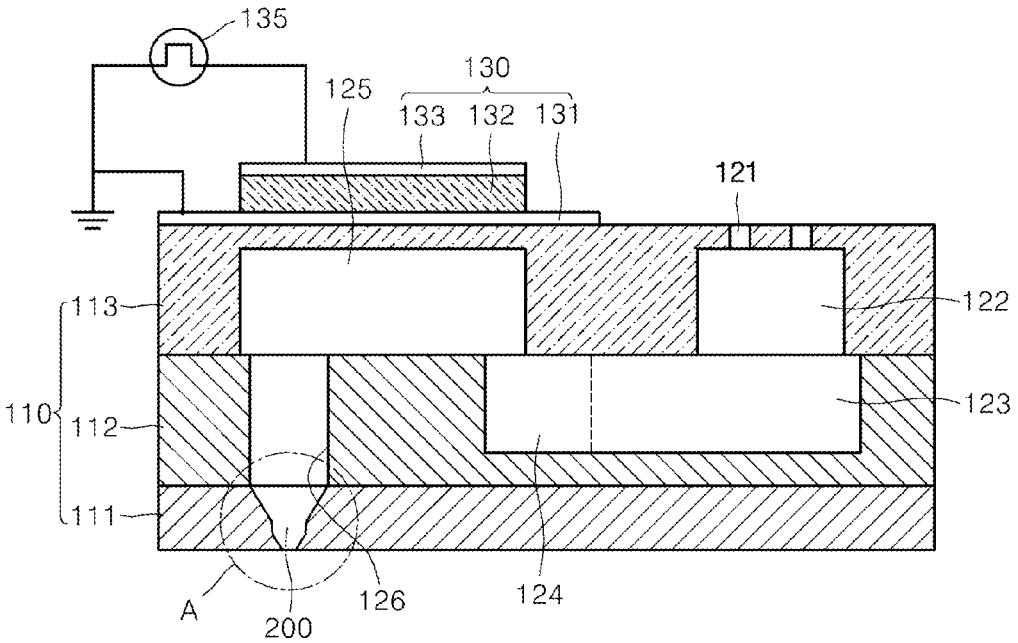
FIG. 1 is a schematic cross-sectional view illustrating an inkjet printing apparatus according to at least one example embodiment.

Example embodiments will be understood more readily by reference to the following detailed description and the accompanying drawings. The example embodiments may, however, be embodied in many different forms and should not be construed as being limited to those set forth herein. Rather, these example embodiments are provided so that this disclosure will be thorough and complete. In at least some example embodiments, well-known device structures and well-known technologies will not be specifically described in order to avoid ambiguous interpretation.

It will be understood that when an element is referred to as being "connected to" or "coupled to" another element, it can be directly on, connected or coupled to the other element or intervening elements may be present. In contrast, when an element is referred to as being "directly connected to" or "directly coupled to" another element, there are no intervening elements present. Like numbers refer to like elements throughout. As used herein, the term "and/or" includes any and all combinations of one or more of the associated listed items.

It will be understood that, although the terms first, second, third, etc., may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the example embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including" when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which these example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Spatially relative terms, such as "below", "beneath", "lower", "above", "upper", and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

FIG. 1 is a configuration view illustrating an inkjet printing apparatus according to at least one example embodiment. FIG. 1 shows a flow channel plate 110 and an actuator providing a driving force for ejecting ink droplets. The actuator includes a piezoelectric actuator 130 providing a pressure-driving force.

The flow channel plate 110 includes an ink channel and a plurality of nozzles 200 for ejecting ink droplets. The ink channel may include an ink inlet 121, into which ink flows, and a plurality of pressure chambers 125 for containing the ink. The ink inlet 121 may be formed at an upper side of the flow channel plate 110 and may be connected to an ink tank (not shown). Ink supplied from the ink tank flows into the inside of the flow channel plate 110 via the ink inlet 121. The plurality of pressure chambers 125 are formed in the flow channel plate 110, and ink that entered through the ink inlets 121 is stored in the pressure chambers 125. Manifolds 122 and 123 and a restrictor 124 may be formed in the flow channel plate 110. The manifolds 122 and 123 connect the ink inlets 121 and the pressure chambers 125. The plurality of nozzles 200 are connected to the pressure chambers 125. Ink stored in the pressure chambers 125 is ejected in the form of droplets through the nozzles 200. The nozzles 200 may be formed at a lower side of the flow channel plate 110 in a single row or in two or more rows. A plurality of dampers 126 for connecting the pressure chambers 125 and the nozzles 200 to one another may be formed in the flow channel plate 110.

The flow channel plate 110 may be a substrate formed of a material having desirable micromachining properties, such as a silicon substrate. For example, the flow channel plate 110 may include a channel forming substrate in which the ink channel is formed and a nozzle substrate 111 in which the nozzles 200 are formed. The channel forming substrate may include first and second channel forming substrates 113 and 112. The ink inlets 121 may be formed to penetrate the first channel forming substrate 113 at an uppermost side of the flow channel plate 110, and the pressure chambers 125 may be formed in the first channel forming substrate 113 so as to have a desired (or alternatively, predetermined) depth from a bottom surface of the first channel forming substrate 113. The nozzles 200 may be formed to penetrate a substrate at a lowermost side of the flow channel plate 110; i.e., the nozzle substrate 111. The manifolds 122 and 123 may be formed in the first channel forming substrate 113 and the second channel forming substrate 112, respectively. The dampers 126 may be formed to penetrate the second channel forming substrate 112. The three substrates that are sequentially stacked, that is, the first and second channel forming substrates 113 and 112 and the nozzle substrate 111, may be bonded to each other by silicon direct bonding (SDB). The ink channel formed inside the flow channel plate 110 is not limited to the shape shown in FIG. 1, and may be variously formed and disposed.

The piezoelectric actuator 130 provides a piezoelectric driving force for ejecting ink, that is, a change in pressure, to the pressure chambers 125. The piezoelectric actuator 130 is formed on the flow channel plate 110 and corresponds to the pressure chambers 125. The piezoelectric actuator 130 may include a lower electrode 131, a piezoelectric layer 132, and an upper electrode 133 that are sequentially stacked on the flow channel plate 110. The lower electrode 131 may serve as a common electrode, and the upper electrode 133 may serve as a driving electrode for applying a voltage to the piezoelectric layer 132. A piezoelectric voltage applier 135 applies a piezoelectric driving voltage to the lower electrode 131 and the upper electrode 133. The piezoelectric layer 132 is deformed by the piezoelectric driving voltage applied by the piezoelectric voltage applier 135 to deform the first channel forming substrate 113 constituting an upper wall of the pressure chambers 125. The piezoelectric layer 132 may be formed of a desired (or alternatively, predetermined) piezoelectric material, for example, a lead zirconate titanate (PZT) ceramic material.

Figure 2:
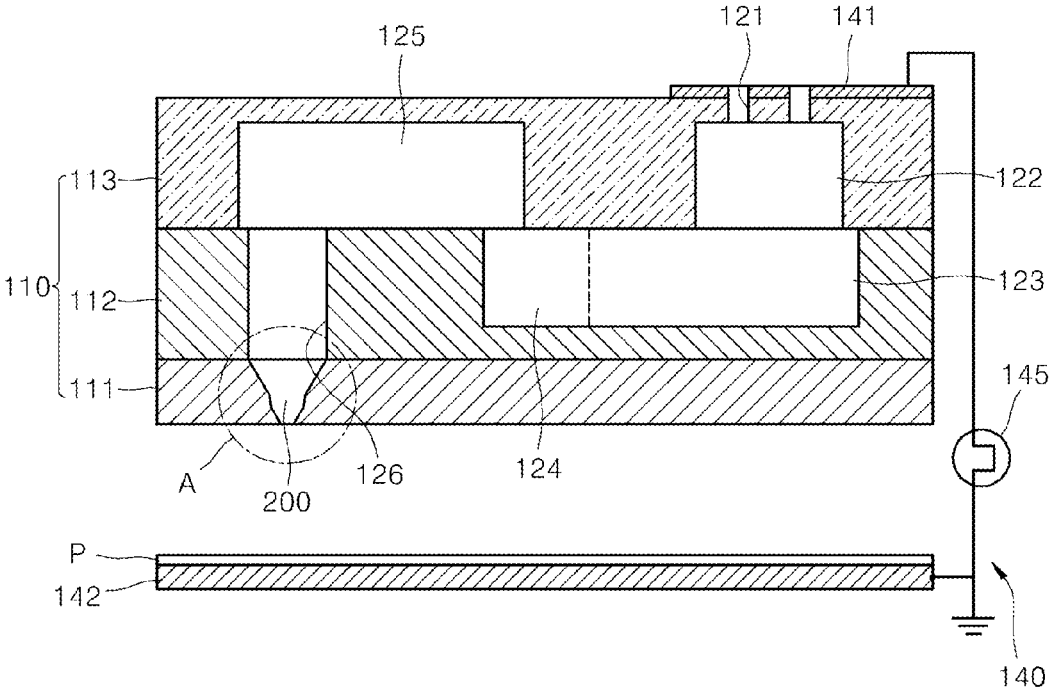
FIG. 2 is a schematic cross-sectional view illustrating an inkjet printing apparatus according to at least one example embodiment.

FIG. 2 is a schematic cross-sectional view illustrating an inkjet printing apparatus according to at least one example embodiment. Referring to FIG. 2, the inkjet printing differs from that of FIG. 1 in that FIG. 2 includes an electrostatic actuator 140 providing an electrostatic driving force. The electrostatic actuator 140 may provide an electrostatic driving force to ink contained in the nozzles 200. The electrostatic actuator 140 may include a first electrostatic electrode 141 and a second electrostatic electrode 142 that face each other. An electrostatic voltage applier 145 applies an electrostatic voltage between the first electrostatic electrode 141 and the second electrostatic electrode 142.

For example, the first electrostatic electrode 141 may be disposed on the flow channel plate 110. The first electrostatic electrode 141 may be formed on an upper surface of the flow channel plate 110, that is, on an upper surface of the first channel forming substrate 113. In this case, the first electrostatic electrode 141 may be formed on a portion of the flow channel plate 110 in which the ink inlets 121 are formed. The second electrostatic electrode 142 may be disposed to be spaced apart from a lower surface of the flow channel plate 110. A printing medium P, on which ink droplets ejected from the nozzles 200 of the flow channel plate 110 are printed, is positioned on the second electrostatic electrode 142.

The electrostatic voltage applier 145 may apply a pulse-type electrostatic driving voltage. In FIG. 2, the second electrostatic electrode 142 is grounded, but the first electrostatic electrode 141 may be grounded instead. The electrostatic voltage applier 145 may apply a direct current (DC) voltage type electrostatic driving voltage. The position of the first electrostatic electrode 141 is not limited to that illustrated in FIG. 2. Although not shown in the drawings, the first electrostatic electrode 141 may be formed in the flow channel plate 110. For example, the first electrostatic electrode 141 may be formed on bottom surfaces of the pressure chambers 125, the restrictor 124, and the manifold 123. However, example embodiments are not limited thereto, and the first electrostatic electrode 141 may be formed in any position inside the flow channel plate 110.

Figure 3:
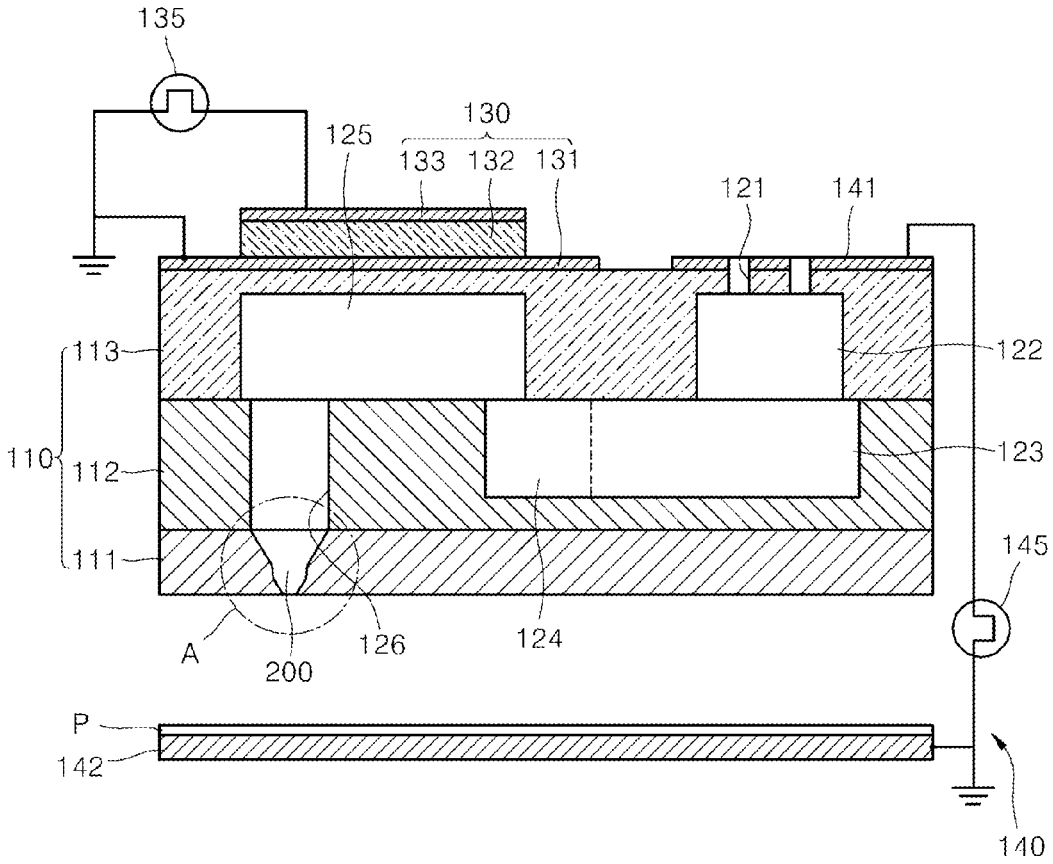
FIG. 3 is a schematic cross-sectional view illustrating an inkjet printing apparatus according to at least one example embodiment.

In FIGS. 1 and 2, the inkjet printing apparatuses, including the piezoelectric actuator 130 and the electrostatic actuator 140, respectively, have been described but example embodiments are not limited thereto. As shown in FIG. 3, both the piezoelectric actuator 130 and the electrostatic actuator 140 providing a piezoelectric driving force and an electrostatic driving force, respectively, may be included. In this case, the first electrostatic electrode 141 may be formed integrally with the lower electrode 131.

Figure 4A:
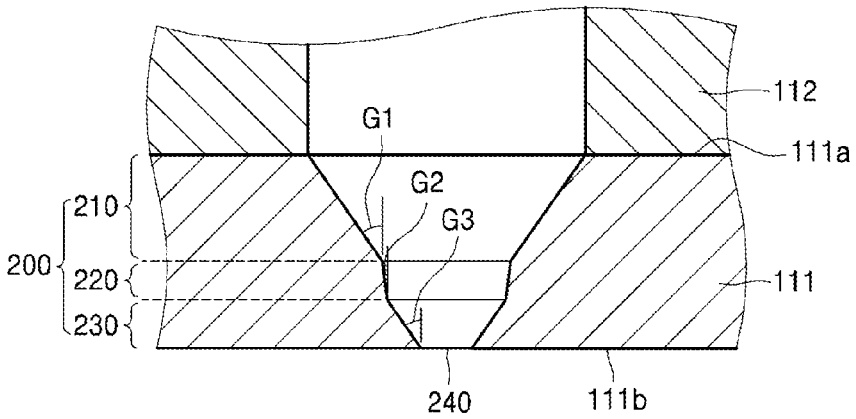
FIG. 4A is a detailed view illustrating region "A" shown FIGS. 1, 2, and 3 according to at least one example embodiment.

FIG. 4A is view illustrating region "A" shown in FIGS. 1, 2, and 3, according to at least one example embodiment. Referring to FIG. 4A, the nozzles 200 are formed to penetrate the nozzle substrate 111. The nozzles 200 have an overall tapered shape in which a size of a cross-section thereof is reduced from an upper surface 111*a* of the nozzle substrate 111 to a lower surface 111*b* thereof.

The nozzles 200 include first nozzle parts 210, second nozzle parts 220, and third nozzle parts 230 which are formed in the nozzle substrate 111. The first nozzle parts 220 are connected to the pressure chambers 125 and have a tapered shape in which a size of a cross-section thereof is reduced from the upper surface 111*a* of the nozzle substrate 111 to the lower surface 111*b* thereof. The second nozzle parts 220 extend toward the lower surface 111*b* from the first nozzle parts 210. The second nozzle parts 220 may have one of a tapered shape in which a size of a cross-section thereof is reduced toward the lower surface 111*b* and a cylindrical shape in which a size of a cross section thereof is substantially the same. The third nozzle parts 230 extend to the lower surface 111*b* of the nozzle substrate 111 from the second nozzle parts 220 and have a tapered shape in which a size of a cross-section thereof is reduced toward the lower surface 111*b*. Due to the configuration as described above, the nozzles 200 have outlets 240 with a very small diameter and are in an overall tapered shape.

The nozzles 200, for example, may be in one of a conical shape and a polypyramid shape. The nozzles 200 may be formed to have a quadrangular pyramid shape by performing anisotropic wet etching on a single crystal silicon substrate in which a crystal orientation of an upper surface is an orientation <100>. When a cross-section of the nozzles 200 has a polygonal shape, a diameter of the nozzles 200 may be shown as an equivalent diameter of a circle. To eject minute droplets with a uniform size, a diameter of the outlets 240 may be uniform. Also, controlling a pressure drop within the nozzles 200 contributes to a more precise control of a size of ink droplets.

As in conventional art methods, when forming a plurality of nozzles penetrating the nozzle substrate 111 and having a tapered shape by using a single etching process, a thickness uniformity of the nozzle substrate 111 may have an effect on a diameter uniformity of the outlets 240. In other words, a diameter of an outlet of a nozzle formed in a thicker area of the nozzle substrate 111 may be smaller than a diameter of an outlet of a nozzle formed in a thinner area the nozzle substrate 111. Also, when applying an anisotropic etching process to form tapered nozzles in a single-crystal silicon substrate, a relatively long etching time may be desired in order to penetrate the entire substrate. Crystal defects may exist inside a silicon substrate, which cause a sectional difference of an etching speed, thereby decreasing the uniformity of a shape and a size of nozzles. Also, hydrogenous bubbles generated in the etching process may be temporarily adsorbed onto a surface of the substrate, thereby further deteriorating the uniformity of the nozzles.

Figure 4B:
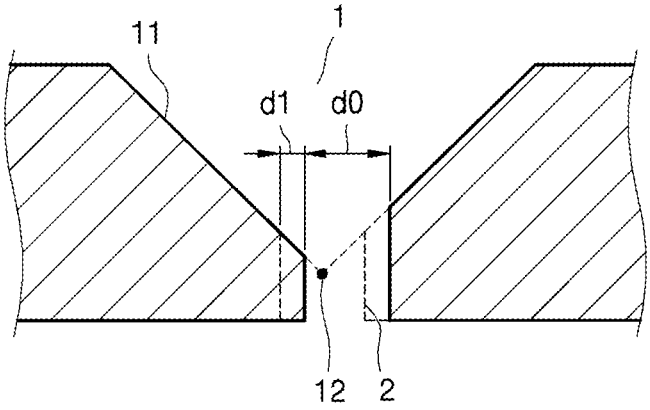
FIG. 4B is a cross-sectional view illustrating a misalignment that occurs at a tapered part and a penetration part of a nozzle.

As shown in FIG. 4B, a tapered part of a nozzle is formed not to penetrate a lower surface of a single crystal silicon substrate by using an anisotropic etching process on a surface of the substrate, and a penetration hole (i.e., an outlet) is formed from the lower surface of the substrate to the tapered part by using an additional process. However, as shown in FIG. 4B, when an apex 12 of a tapered part 11 of a nozzle 1 is not accurately aligned with a penetration hole 2, (i.e., there is a misalignment between the apex 12 of the tapered part 11 and the penetration hole 2), a relatively large pressure drop may be caused while ejecting ink. In other words, when there is a misalignment, a length of the penetration hole 2 connected to the tapered part 11 is longer than a case with no misalignment (shown by a dashed line) in such a way that a pressure drop may become relatively large while ejecting ink. Accordingly, an actuator providing a relatively large driving force may be desired in order to compensate for the pressure drop. Also, when a misalignment occurs, since the tapered part 11 becomes asymmetrical to an ejecting direction, directivity properties of ink may be deteriorated. An effect of asymmetry on the directivity properties of the ink increases as a diameter of nozzles decreases. Accordingly, when forming nozzles having a diameter, for example, of 3 microns to eject minute droplets, a misalignment may have a negative effect on the directivity properties of the ink.

As shown in FIG. 4A, according to at least one example embodiment, the nozzles 200 are formed of the first to third nozzle parts 210, 220, and 230. According to this configuration, since the first to third nozzle parts 210, 220, and 230 may be formed by individual processes, etching times may be reduced for the individual processes. Accordingly, a manufacturing process of the nozzles 200 may be less influenced by crystal defects and bubbles of the nozzle substrate 111.

Also, since the diameter of the outlets 240 of the nozzles 200 depend on the tapered third nozzle parts 230 formed by individual processes, nozzles having outlets 240 with more uniform diameters may be provided by reducing the effects caused by a non-uniform thickness of the nozzle substrate 111.

Figure 4C:
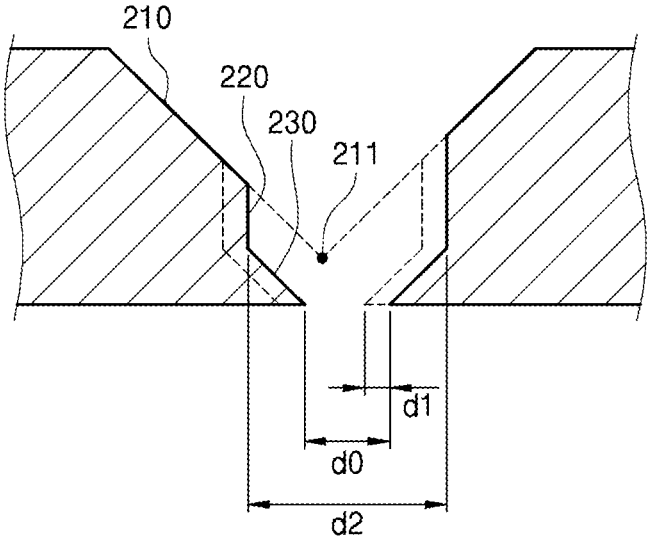
FIG. 4C is a cross-sectional view illustrating that asymmetrical properties of a nozzle occurring due to the misalignment are alleviated by the nozzle shown in FIG. 4A.

Also, in the nozzles 200 according to at least one example embodiment, a pressure drop may be reduced by alleviating asymmetry of the nozzles 200, which may improve directivity properties of ejected ink. Referring to FIG. 4B, where nozzles are formed by two etching processes, when a diameter d0 of the nozzle 1 is, for example, 3 microns and a misalignment d1 is 1.5 microns, the misalignment d1 is about 50% of the diameter d0 of the nozzle 1. Referring to FIG. 4C, wherein the nozzles 200 are formed by three etching processes in accordance with at least one example embodiment, the first nozzle parts 210 and the third nozzle parts 230 are connected to one another by the second nozzle parts 220, thereby forming the nozzles 200 in an overall uniform tapered shape.

Further, referring to FIG. 4C, assuming that the third nozzle parts 230 are deviated from apexes 211 of the first nozzle parts 210 by d1, only a diameter d2 of the second nozzle parts 220 has an effect on asymmetry. The diameter d2 of the second nozzle part 220 is greater than the diameter d0 of the third nozzle parts 230. For example, when the diameter d0 of the third nozzle parts 230 is about 3 microns, the diameter d2 of the second nozzle parts 220 is, for example, about 30 microns. Accordingly, asymmetry caused by the deviation amount d1 (i.e., 1.5 microns) is about 5% of the diameter d2 of the second nozzle parts 220, which means the asymmetry may be reduced to about 1/10, relative to that shown in FIG. 4B. As described above, since the nozzles 200 have the outlets 240 with the minute diameter d0 and are in a tapered shape with substantial uniformity (i.e., relatively small asymmetry), the pressure drop caused by asymmetry may be reduced and the directivity properties of ink may be increased.

Referring to FIG. 4A, the first to third nozzle parts 210, 220, and 230 may have first to third taper angles G1, G2, and G3, respectively. Taper directions of the first to third nozzle parts 210, 220, and 230 may be the same. For example, the first to third nozzle parts 210, 220, and 230 may be in a shape in which a size of a cross-section thereof is reduced toward the lower surface 111*b* of the nozzle substrate 111. The second taper angle G2 is an acute angle to a direction in which the nozzle 200 extends. That is, the second taper angle G2 is less than 90 degrees. The second taper angle G2 may be less than the first and third taper angles G1 and G3. Also, the first taper angle G1 and the third taper angle G3 may be the same.

Figure 5A:
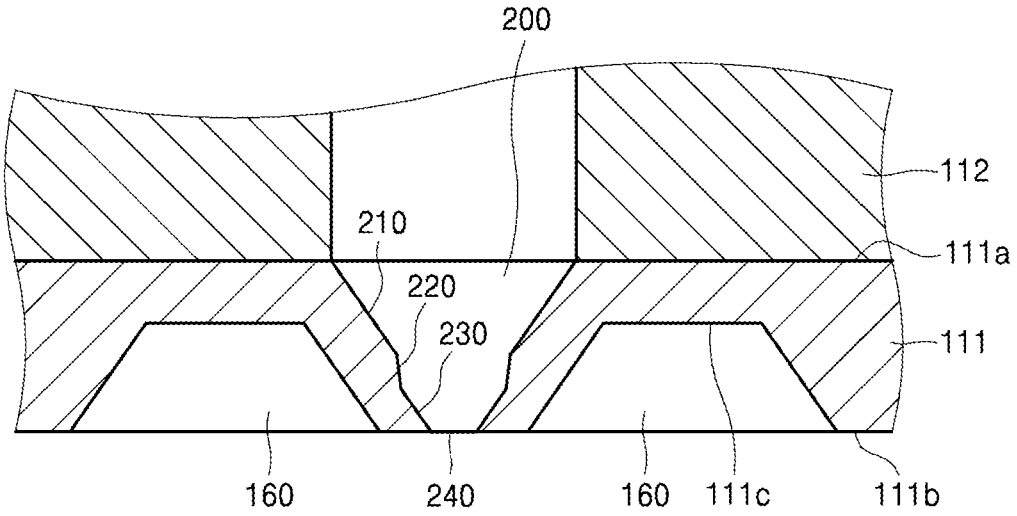
FIG. 5A is a partial cross-sectional view illustrating an inkjet printing apparatus including trenches, according to at least one example embodiment.

FIG. 5A is a cross-sectional view illustrating an inkjet printing apparatus according to at least one example embodiment. Referring to FIG. 5A, in the inkjet printing apparatus, a trench 160 depressed from the lower surface 111*b* toward a trench surface 111*c* may be formed. Accordingly, an overall shape of the nozzle 200 may be pointed downwardly.

Figure 5B:
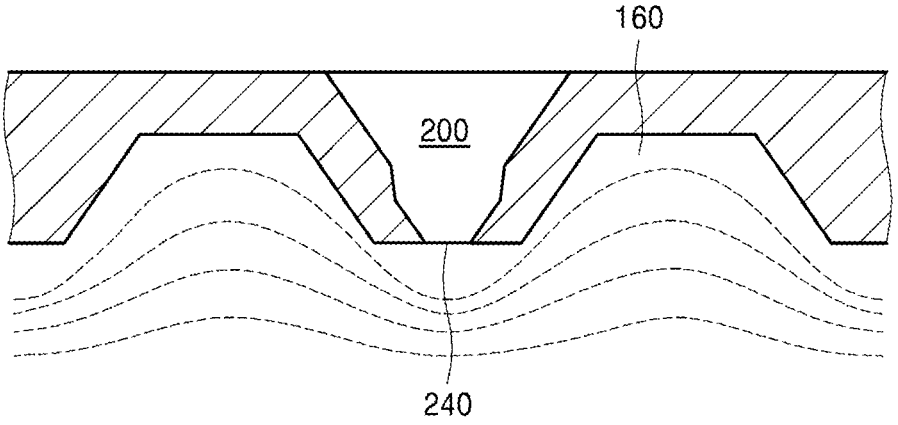
FIG. 5B is a view illustrating equipotential lines around a nozzle outlet.

Generally, electric charges converge at a pointed part of, for example, a nozzle 200. Referring to FIG. 5B, equipotential lines caused by an electrostatic driving voltage converge on around the outlet 240 of the nozzle 200 due to the trench 160, thereby forming a relatively large electric field around the outlet 240 of the nozzle 200 such that an electrostatic driving force at the outlet 240 of the nozzle 200 may be increased. Accordingly, droplets may be effectively accelerated and a size of the droplets further reduced according to a level of the electrostatic driving voltage. Also, minute droplets of several picoliters, and further, several femtoliters, may be stably ejected toward a printing medium P.

Figure 5C:
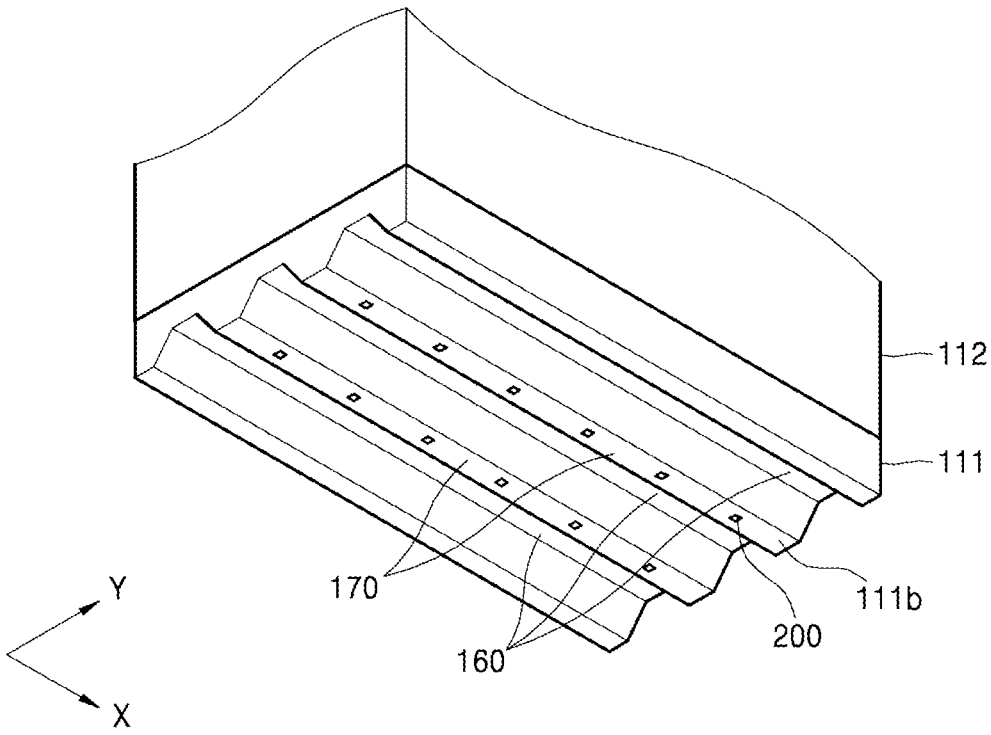
FIG. 5C is a perspective view illustrating an inkjet printing apparatus with trenches formed around nozzles.

FIG. 5C is a perspective view illustrating an inkjet printing apparatus according to at least one example embodiment, wherein trenches 160 are formed around nozzles 200. Referring to FIG. 5C, a nozzle block 170 extends in a first direction X on the nozzle substrate 111 and the trench 160 is located in a second direction Y orthogonal to the first direction X and extends in the first direction X. Accordingly, the nozzle substrate 111 has a shape in which the nozzle blocks 170 and the trenches 160 are alternately arranged in the second direction Y, and the trenches 160 are located on both sides of the nozzle block 170 in the second direction Y, respectively. The nozzle 200 is formed to penetrate the nozzle block 170 of the nozzle substrate 111.

While performing a printing process by using an inkjet printing apparatus, ink or dust may collect at the lower surface 111*b* of the nozzle substrate 111 around the exit 240 of the nozzle 200. Such impurities may deform a shape and an amount of ink droplets ejected via the nozzle 200 and/or may distort a direction of ejecting the ink droplets. Accordingly, before ejecting ink via the nozzle 200 or after a desired (or alternatively, predetermined) number of times of ejecting the ink, a wiping process may be performed to remove particles collected at the lower surface 111*b* around the exit 240 of the nozzle 200. The wiping process, for example, may be performed by wiping the lower surface 111*b* of the nozzle substrate 111 in one of the first direction X and the second direction Y by using a wiping element such as a blade and a roller formed of one of rubber and felt.

In the inkjet printing apparatus of FIG. 5C, the nozzles 200 are formed in the nozzle blocks 170 extended in the first direction X and the trenches 160 are formed on sides of the nozzle blocks 170 in the second direction Y. Accordingly, since the nozzle blocks 170 are in the shape that overall extends in the first direction X, the nozzle blocks 170 have considerable strength. Thus, damage to the nozzles 200 during the wiping process may be reduced. In addition, a cross-section of the nozzle 200 in the second direction Y maintains a pointed shape, thereby increasing the electrostatic driving force.

Composite-type inkjet printing apparatuses eject minute droplets of ink by providing a piezoelectric driving force and an electrostatic driving force to the ink and may be driven in a plurality of driving modes for ejecting ink droplets in different sizes and shapes by controlling applying sequences, levels, and application duration times of the piezoelectric driving voltage and the electrostatic driving voltage applied to the piezoelectric actuator 130 and the electrostatic actuator 140. For example, a composite-type inkjet printing apparatus may be driven in a dripping mode of ejecting minute droplets with a size smaller than a size of a nozzle, a cone-jet mode of ejecting minute droplets with a size smaller than the dripping mode, and/or a spray mode of ejecting ink droplets in a jet-stream shape.

As described above, since a piezoelectric driving method is used with an electrostatic driving method, it is possible to eject ink in a drop on demand (DOD) method to easily control a printing process. Also, because the nozzles 200 have a tapered shape and the trenches 160 are formed around the nozzles 200, directivity properties of the ejected ink droplets may be improved and minute droplets achieved.

Figure 6A:
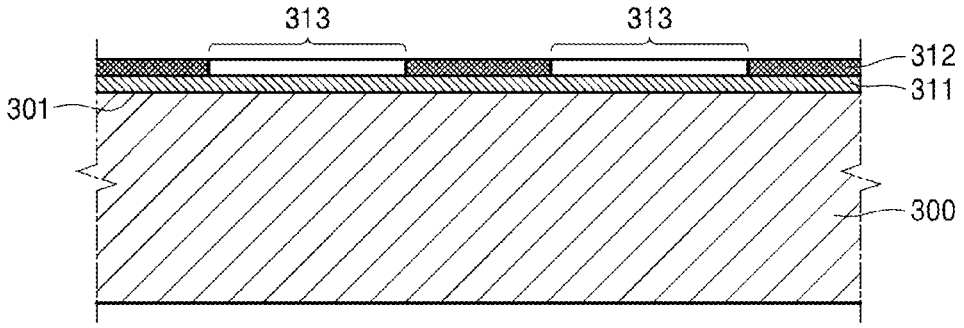
FIGS. 6A to 6N are views illustrating a method of forming nozzles, according to at least one example embodiment.
Figure 6B:
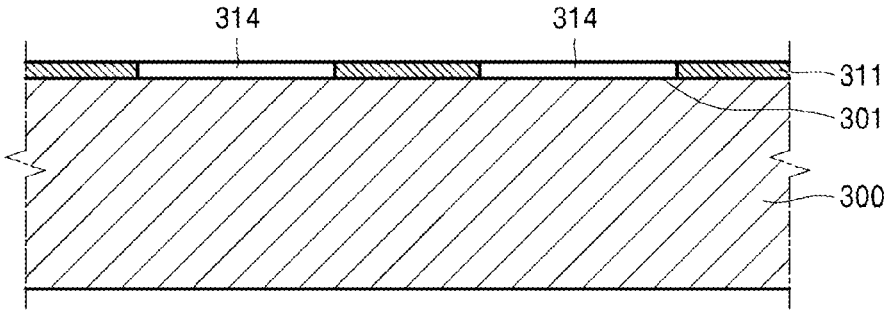

Hereinafter, a method of forming the nozzles 200 according to at least one example embodiment is described with reference to FIGS. 6A to 6N.

[Forming a First Depression 410]

An etch mask is formed on a surface of a substrate 300. For example, referring to FIG. 6A, the substrate 300, in which a crystal orientation of an upper surface 301 is an orientation <100>, is prepared. The substrate 300 may be a single crystal silicon substrate. Then, a mask layer 311 is formed. The mask layer 311 may be, for example, a SiO2 layer. The SiO2 layer may be formed by oxidizing the substrate 300. A photoresist layer 312 is formed on the mask layer 311, and then the photoresist layer 312 is patterned by, for example, a photolithography to expose a portion 313 of the mask layer 311. The mask layer 311 is patterned by using the photoresist layer 312 as a mask, thereby forming the mask layer 311 having an aperture 314, as illustrated in FIG. 6B. A process of patterning the mask layer 311 may be performed through a wet etching process using an HF solution (a buffered hydrogen fluoride acid) or a plasma dry etching process.

The aperture 314 may have, for example, a circular shape. A diameter of the aperture 314 may be determined according to a diameter of the nozzle 200 that will be finally formed. When employing the mask layer 311 with the aperture 314 formed in a circular shape, an alignment between a crystal orientation of the substrate 300 and a mask pattern is not necessary during an anisotropic wet etching process that will be described later. Accordingly, it is possible to mitigate (or alternatively, prevent) non-uniformity of the shape of the nozzle 200 caused by a misalignment with the crystal orientation of the substrate 300.

Figure 6C:
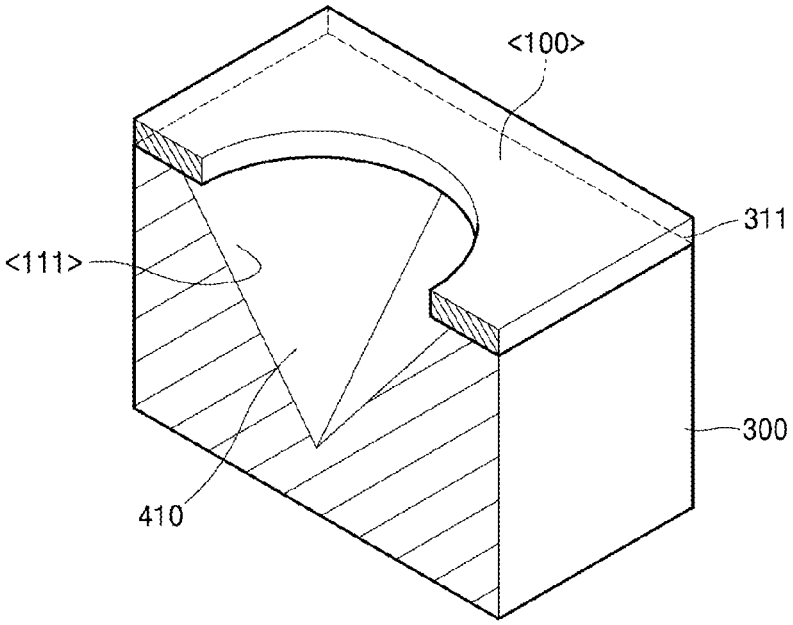
Figure 6D:
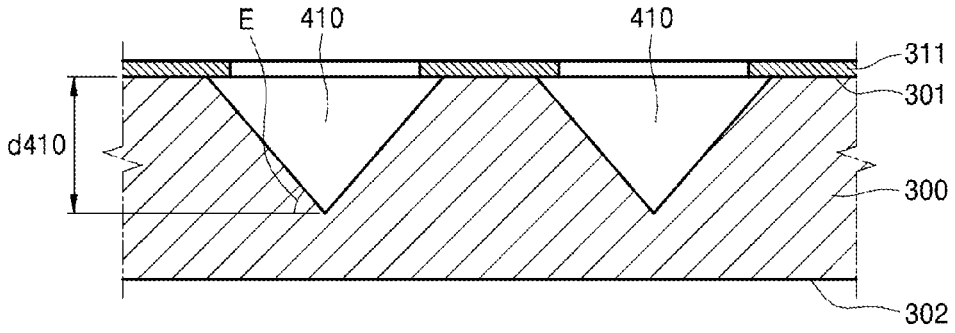

Referring to FIG. 6C, the substrate 300 is etched from the upper surface 301 (i.e., a first surface) by using the mask layer 311 as an etch mask. The etching process may be performed by anisotropic wet etching using, for example, 20% of tetramethyl ammonium hydroxide (TMAH) at a temperature of 90° C. In this case, an etching speed may be about 0.8~0.9 μm/min. Referring to FIG. 6C, the crystal orientation of the upper surface 301 of the substrate 300 is an orientation <100>, and a crystal orientation of an etched surface is an orientation <111>. Due to a difference in etching speeds between the orientation <100> and the orientation <111>, the etching may be performed rapidly downward and slowly sideward. Thus, as illustrated in FIGS. 6C and 6D, a first depression 410 is formed in the substrate 300 to have a tapered shape in which a cross-sectional area thereof decreases downward. The first depression 410 may be formed to have a quadrangular pyramid shape that is an inverted pyramid shape and a cross-sectional area thereof is rectangular. In detail, since some underetching occurs toward the outside of the aperture 314, an upper end of the first depression 410 formed in the quadrangular pyramid shape may not be perfectly inscribed in the aperture 314 formed in a circular shape. An inclined angle E of the first depression 410 may be, for example, about 54.7 degrees according to a wet anisotropic etching process.

Figure 6E:
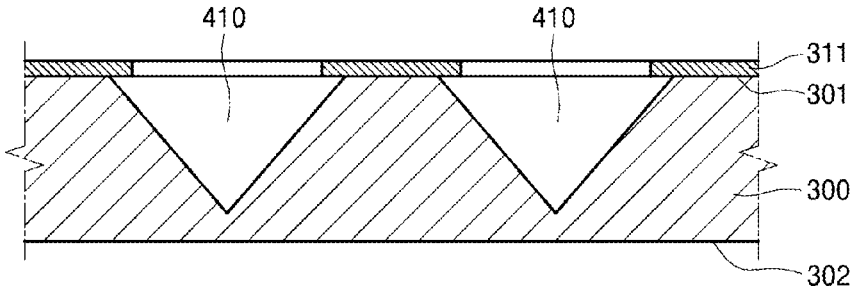

As shown in FIG. 6C, the first depression 410 does not penetrate a lower surface 302 (i.e., a second surface). By controlling an etching time, a depth d410 of the first depression 410 may be controlled. If desired, as shown in FIG. 6E, a thinning process of polishing the lower surface 302 of the substrate 300 by etching, polishing, etc. may be performed.

[Forming a Penetration 440]

Figure 6F:
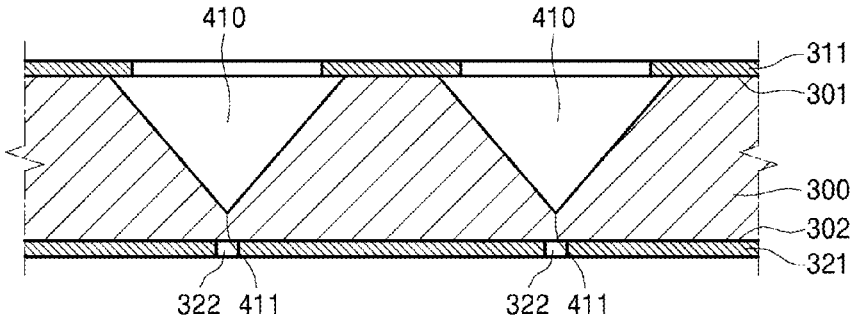

As shown in FIG. 6F, a mask layer 321 with an aperture 322 aligned with an apex 411 of the first depression 410 may be formed on the lower surface 302 of the substrate 300. The mask layer 321, for example, may be formed of one of $SiO_2$ and $Si_2N_4$. On the lower surface 302 of the substrate 300, one of $SiO_2$ and $Si_2N_4$ may be deposited to form mask layer 321, and then, a portion of $SiO_2$ or $Si_2N_4$ corresponding to a location aligned with the apex 411 of the first depression 410 may be removed, thereby forming the aperture 322.

Figure 6G:
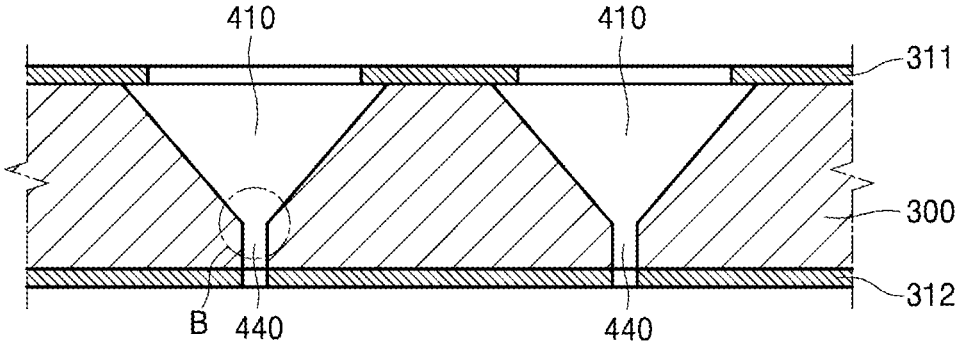

The substrate 300 may be, for example, dry-etched from the lower surface 302 by using the mask layer 321 as an etch mask, thereby forming the penetration 440 (i.e., the eventual nozzle outlet) that is connected to the first depression 410, as shown in FIG. 6G.

Figure 6H:
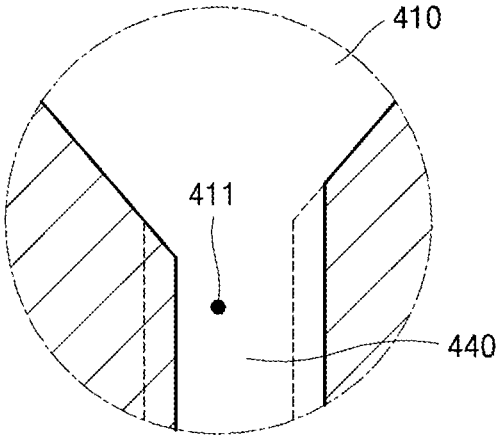

FIG. 6H is a detailed view illustrating region "B" of FIG. 6G. Referring to FIG. 6H, ideally the penetration 440 may be accurately aligned with the first depression 410 as shown by the dashed line. However, in many cases, a misalignment may occur, and as shown by a solid line, the penetration 440 may be offset from the apex 441 of the first depression 410. In the ideal case, as shown by the dashed line, the penetration 440 and the first depression may be symmetrical to a penetration direction. However, when the misalignment occurs, as shown by the solid line, a length of the penetration 440 in the penetration direction becomes non-uniform and the first depression 410 is also asymmetrical to the penetration direction. As described above, this may cause an undesired pressure drop and a deterioration of directivity properties while ejecting ink.

[Forming a Second Depression 420 and a Third Depression 430]

To resolve the misalignment described above, a process of etching the first depression 410 and the penetration 440 may be performed. In FIG. 6G, the mask layer 311 and the mask layer 321 may be used as etch masks. The etching, for example, may be performed by a wet anisotropic etching process identical or similar to the process of forming the first depression 410. However, since an etching amount is small, a process time of forming the second depression 420 may be less than the process of forming the first depression 410. The process times differ according to conditions but may be determined to be, for example, about 10 minutes.

Figure 6I:
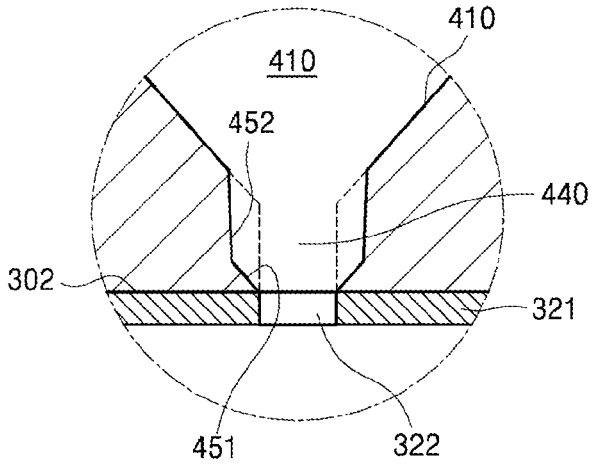
Figure 6J:
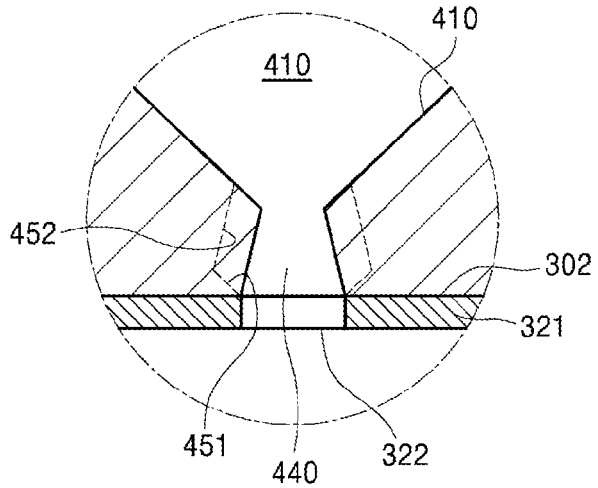
Figure 6K:
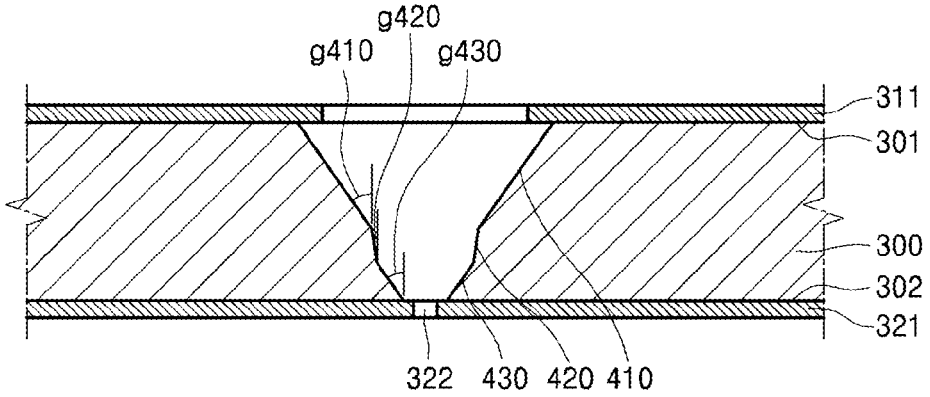

Referring to FIG. 6I, as etching a wall surface of the penetration 440 starts, an etched surface 451 in an orientation <111> is formed from the lower surface 302 of the substrate 300. Further, a connection surface 452 connecting the etched surface 451 to the first depression 410 may also be formed. As the etching progresses, as shown in FIG. 6K, the first depression 410, the second depression 420, and the third depression 430 may be formed. The third depression 430 may be formed by the etched surface 451, and the second depression 420 may be formed by the connection surface 452 connecting the etched surface 452 to the first depression 410. The connection surface 452 may be shifted while maintaining a primary penetration angle as the wall surface of the penetration 440 is etched. Also, an etching speed in a vertical direction may be faster than an etching speed in a lateral direction. Accordingly, a taper angle g420 of the second depression 420 may be smaller than a taper angle g410 of the first depression 410. Also, the etched surface 451 forming the third depression 430 is in the orientation <111>, and a taper angle g430 of the third depression 430 may be substantially identical to the taper angle g410 of the first depression 410.

The penetration 440 may be parallel to the penetration direction or be in a tapered shape in which a size of a cross section thereof is gradually reduced toward the lower surface 302 of the substrate 300. On the other hand, the penetration 440 may be formed in a tapered shape in which a size of a cross section thereof is gradually increased toward the lower surface 302 of the substrate 300, as a solid line shows in FIG. 6J. As etching on the penetration 440 progresses, as shown in FIG. 6J as a dashed line, the connection surface 452 may have a shape tapered in a direction opposite to those of the first depression 410 and the etched surface 45, thereby may cause a great pressure drop which is not desirable. To mitigate (or alternatively, prevent) this problem, the etching process of the penetration 440 may be maintained until the etched surface 451 arrives at the upper surface 301 of the substrate 300 to remove the connection surface 452. However, in this case, a relatively long etching time may be needed and an increase of a process time may be caused. According to at least one example embodiment, the penetration 440 is formed to be in a cylindrical shape substantially parallel to the penetration direction or be in a tapered shape in the same direction as the first depression 410 in such a way that the first, second, and third depressions 410, 420, and 430 may be formed in tapered shapes in the same direction and the etching process time may be reduced.

Figure 6L:
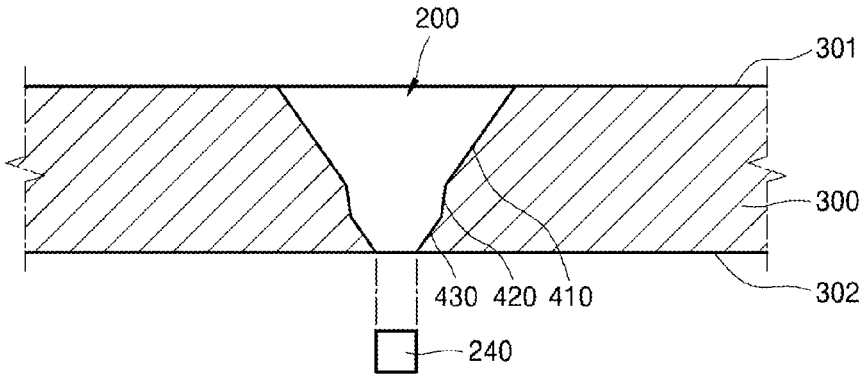

As shown in FIG. 6L, when removing the mask layers 311 and 321, the first depression 410 may have a tapered shape in which the size of the cross section is reduced from the upper surface 301 toward the lower surface 302 of the substrate 300, the second depression 420 may have a tapered shape in which the size of the cross section is reduced from the first depression 410 toward the lower surface 302, and the third depression 430 may have a tapered shape in which the size of the cross section is reduced from the second depression 420 toward the lower surface 302 are formed. The first, second, and third depressions 410, 420, and 430 may correspond to the first, second, and third nozzle parts 210, 220, and 230 of FIG. 4A, respectively. Accordingly, the nozzle 200 as shown in FIG. 4A may be formed.

Since the second and third depressions 420 and 430 are formed by partially etching the first depression 410 and completely etching the penetration 440, asymmetry caused by a misalignment between the first depression 410 and the penetration 440 is mitigated, and the nozzle 200 with the outlet 240 having a uniform square shape and a uniform diameter may be formed, as shown in FIG. 6L.

[Forming the Trench 160]

Figure 6M:
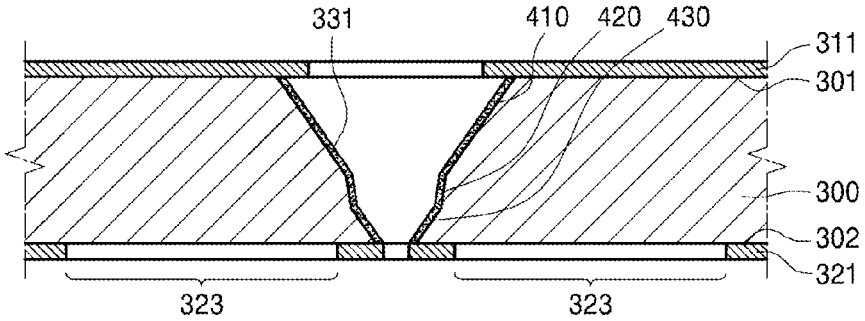
Figure 6N:
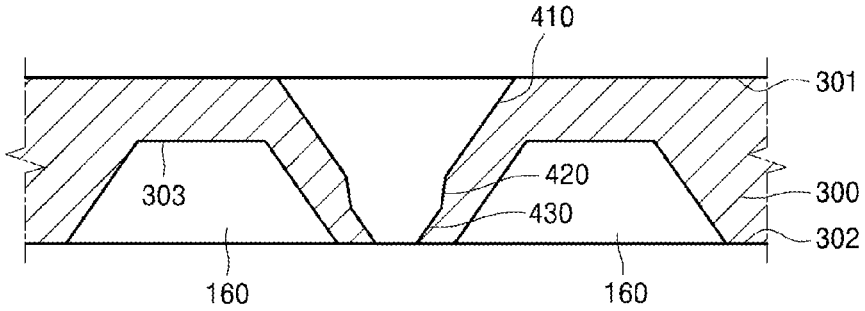

As shown in FIG. 6M, a protection layer 331 is formed on at least inner wall surfaces of the first, second, and third depressions 410, 420, and 430. The protection layer 331 may be a $SiO_2$ layer. In this case, the protection layer 331 may be formed by oxidizing the substrate 300. After that, a portion 323 of the mask layer 321 on the lower surface 302 of the substrate 300 is, for example, removed by a lithographic process, thereby defining a portion for forming the trench 160. Accordingly, the lower surface 302 of the substrate 300 may be partially exposed. A portion for forming the trench 160 may be defined to be different depending on a range for forming the trench 160. For example, as shown in FIG. 5A, when forming the trenches 160 around overall the nozzle 200, the portion 323 is formed in a shape surrounding an outlet of the third depression 430. Also, for example, as shown in FIG. 5C, when forming the trench 160 on only both sides of the nozzle 200 in the one direction, the portion 323 is in the shape of a stripe separate from the outlet of the third depression 430 to be on both sides of the third depression 430.

The substrate 300 is etched from the lower surface 302 to a step surface 303 by using the mask layer 321 as an etch mask, thereby forming the trenches 160. As shown in FIG. 6N, the mask layers 311 and 321 are removed. Accordingly, the inkjet printing apparatus of FIG. 5A with the trenches 160 formed around all of the nozzle 200 or the inkjet printing apparatus of FIG. 5C with the trenches 160 formed in the one direction of the nozzle 200, for example, the Y direction of FIG. 5C, may be manufactured.

With reference to FIGS. 7A to 7F, a method of forming the nozzles 200 according to at least one other example embodiment is described.

[Forming the First Depression 410]

Figure 7A:
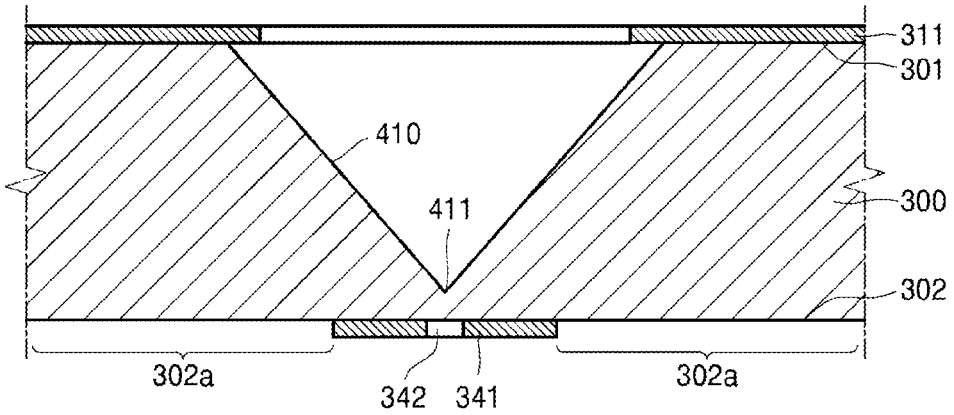
FIGS. 7A to 7F are views illustrating a method of forming nozzles, according to at least one example embodiment.

In FIG. 7A, the first depression 410 may be formed by performing the processes shown in FIGS. 6A to 6E as described above.

[Forming the Penetration 440]

As shown in FIG. 7A, a first mask layer 341 is formed on the lower surface 302 of the substrate 300. The first mask layer 341, for example, may be formed by depositing tetraethoxysilane (TEOS). In the first mask layer 341, an aperture 342 aligned with the apex 411 of the first depression 410 is provided. The first mask layer 341 is formed on a peripheral area around the aperture 342 on the lower surface 302 of the substrate 300. Accordingly, among the lower surface 302 of the substrate 300, an area 302*a* is exposed. The area 302*a* is for forming the trenches 160 as will be described later. Accordingly, the first mask layer 341 defines an area for forming the penetration 440 (i.e., an outlet) and an area for forming the trenches 160. The first mask layer 341 may be formed by depositing a TEOS layer completely on the lower surface 302 of the substrate 300 and removing the TEOS layer corresponding to the aperture 302 and the area 302*a* by, for example, using a lithographic process.

Figure 7B:
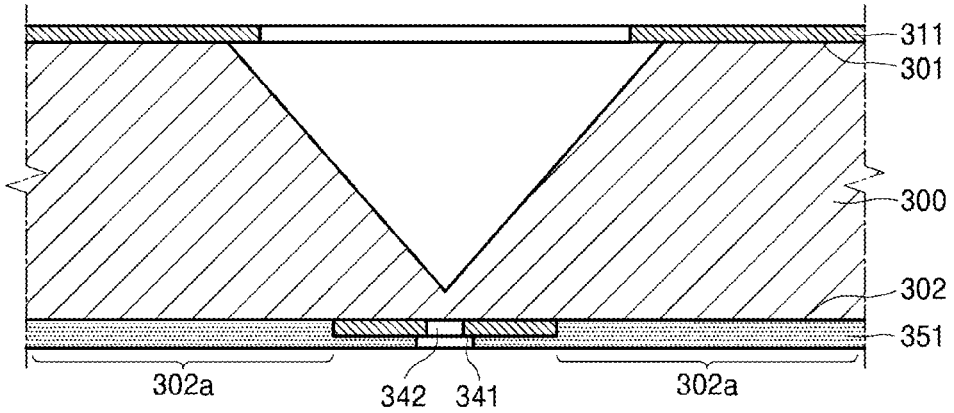

As shown in FIG. 7B, a second mask layer 351 is formed. The second mask layer 351 covers the exposed area 302*a* of the lower surface 302 and the first mask layer 341 except for the aperture 342. The second mask layer 351 may be formed by, for example, applying photoresist.

Figure 7C:
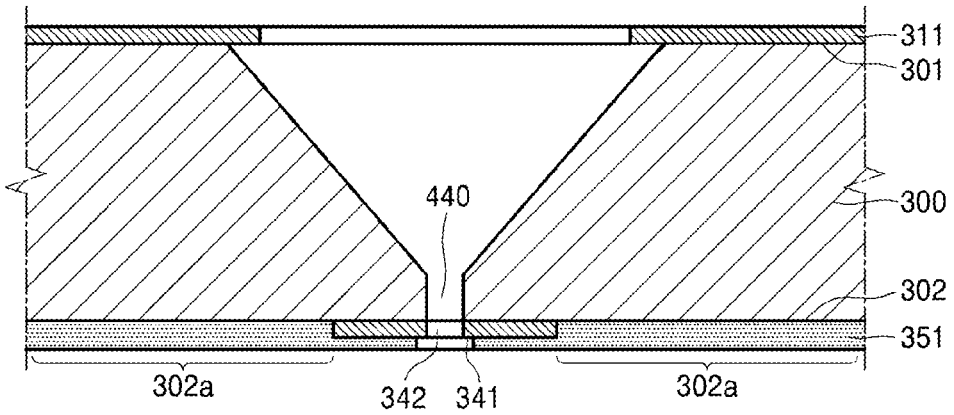

The substrate 300 may be, for example, dry-etched via the aperture 342 by using the second mask layer 351 as an etch mask, thereby forming the penetration 440 connected to the first depression 410, as illustrated in FIG. 7C.

The penetration 440 may have a misalignment with the first depression 410, which has been described with reference to FIG. 6H. Accordingly, a process to compensate for the misalignment may be performed.

[Forming the Second and Third Depressions 420 and 430]

Figure 7D:
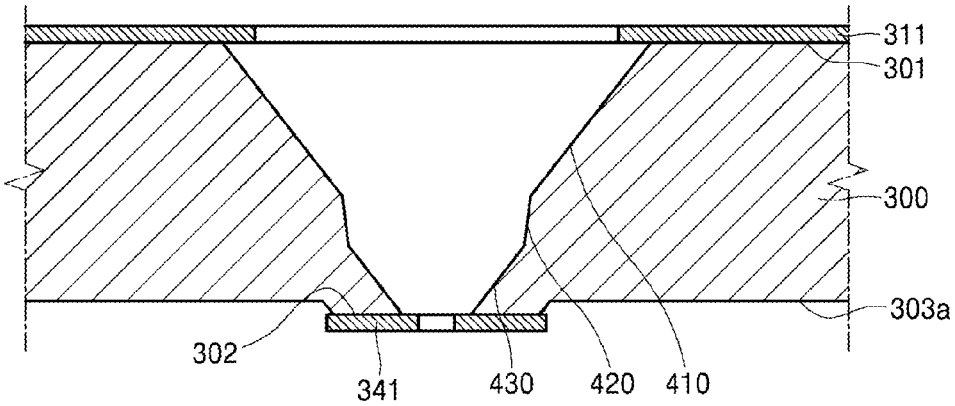

As shown in FIG. 7D, the second mask layer 351 is removed and the penetration 440 is etched by using a wet anisotropic etching process. Then, as described with reference to FIGS. 61 to 6K, the third depression 430 and the second depression 420 are formed by the etched surface 451 and the connection surface 452 connecting the first depression to the etched surface 451, respectively. The first, second, and third depressions 410, 420, and 430 may correspond to the first, second, and third nozzle portions 210, 220, and 230 of FIG. 4A. Accordingly, the nozzle 200 shown in FIG. 4A may be formed. Since the second and third depressions 420 and 430 are formed by partially etching the first depression 410 and completely etching the penetration 440, asymmetry caused by a misalignment between the first depression 410 and the penetration 440 is mitigated and the nozzle 200 with the outlet 240 having a uniform square shape and a uniform diameter may be formed.

The exposed area 302*a* of the lower surface 302 of the substrate 300 may also be partially etched by a wet-etching process, thereby forming a partial step surface 303*a*. In this state, the mask layer 311 and the first mask layer 341 are removed, thereby forming the nozzle 200 as shown in FIG. 4A.

[Forming the Trenches 160]

Figure 7E:
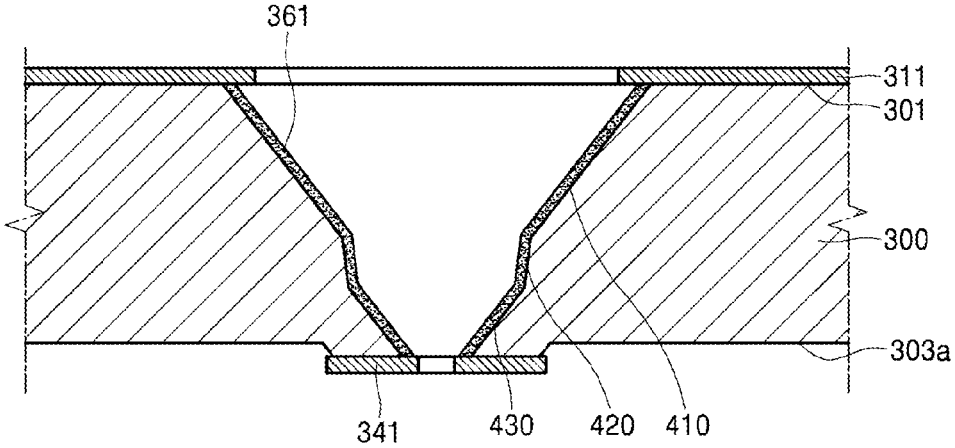

As shown in FIG. 7E, a protection layer 361 is formed on inner wall surfaces of the first, second, and third depressions 410, 420, and 430. The protection layer 361 may be, for example, a TEOS layer. The protection layer 361 is formed to mitigate (or alternatively, prevent) damage to the first, second, and third depressions 410, 420, and 430 during an etching process for forming the trenches 160. On the lower surface 302 of the substrate 300, the first mask layer 341 defining a portion for forming the trenches 160 is formed. The portion for forming the trenches 160 may be defined differently depending on a range of forming the trenches 160. For example, as shown in FIG. 5A, when forming the trenches 160 around overall the nozzle 200, the portion 323 is formed in a shape surrounding an outlet of the third depression 430. Also, for example, as shown in FIG. 5C, when forming the trench 160 on only both sides of the nozzle 200 in the one direction, the portion 323 is in the shape of a stripe separate from the outlet of the third depression 430 to be on both sides of the third depression 430.

Figure 7F:
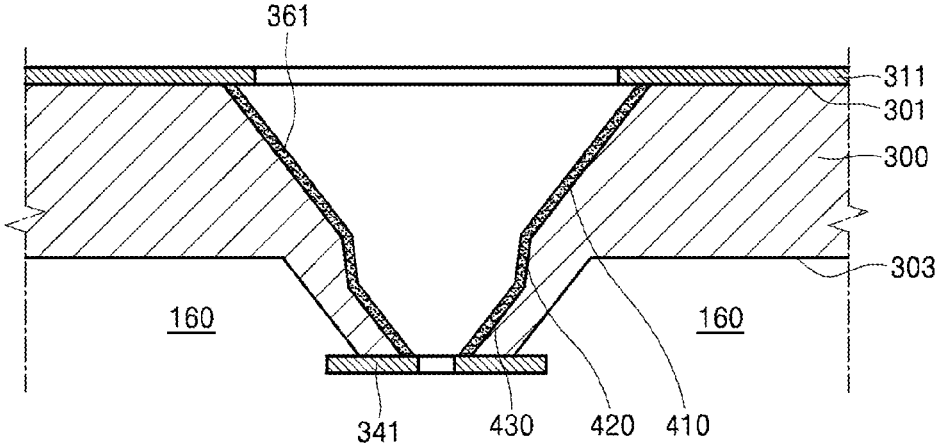

The substrate 300 is etched from the lower surface 302 to a step surface 303 by using the mask layer 341 as an etch mask, thereby forming the trenches 160 as shown in FIG. 7F.

As a post process, when removing the protection layer 361, the mask layer 311, and the first mask layer 341, the inkjet printing apparatus of FIG. 5A with the trenches 160 formed around overall the nozzle 200 or the inkjet printing apparatus of FIG. 5C with the trenches 160 formed in the one direction of the nozzle 200, for example, the Y direction of FIG. 5C may be formed.

Figure 8:
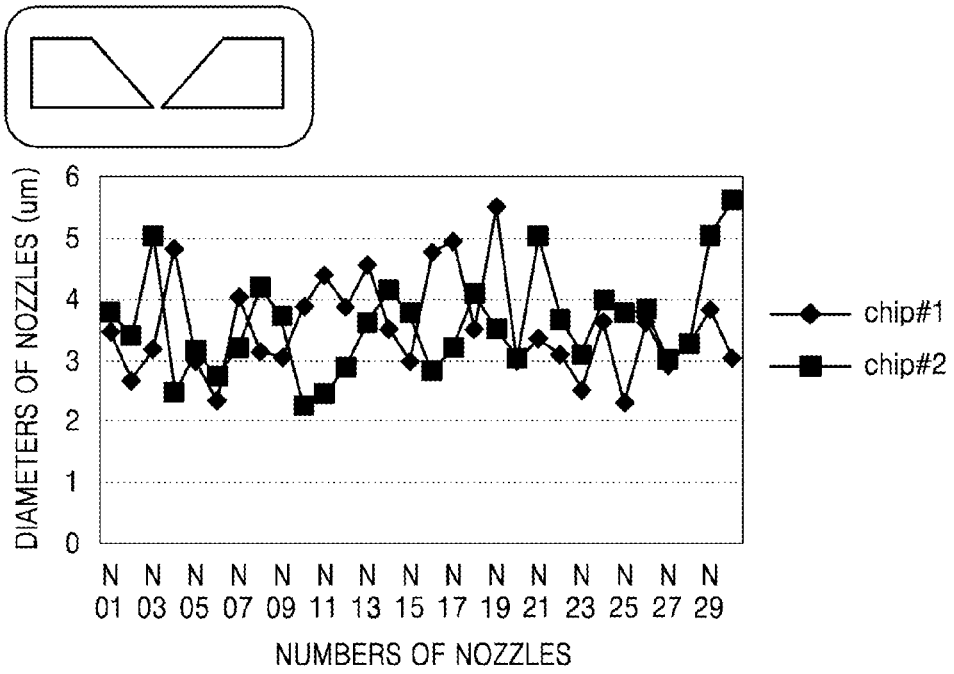
FIG. 8 is a graph illustrating a result of measuring diameters of a plurality of nozzles formed on one chip on a substrate, the plurality of nozzles being formed in a tapered shape by penetrating the substrate by a single process.

FIG. 8 is a graph illustrating a result of measuring diameters of a plurality of nozzles formed on one chip on a substrate, the plurality of nozzles being formed in a tapered shape by penetrating the substrate using a single process. A horizontal axis indicates the number of nozzles formed on the chip of the substrate. A mean value of the diameters is about 3.5 microns, a minimum value is about 2.3 microns, a maximum value is about 5.5 microns, and non-uniformity of the diameters is about 41%.

Figure 9:
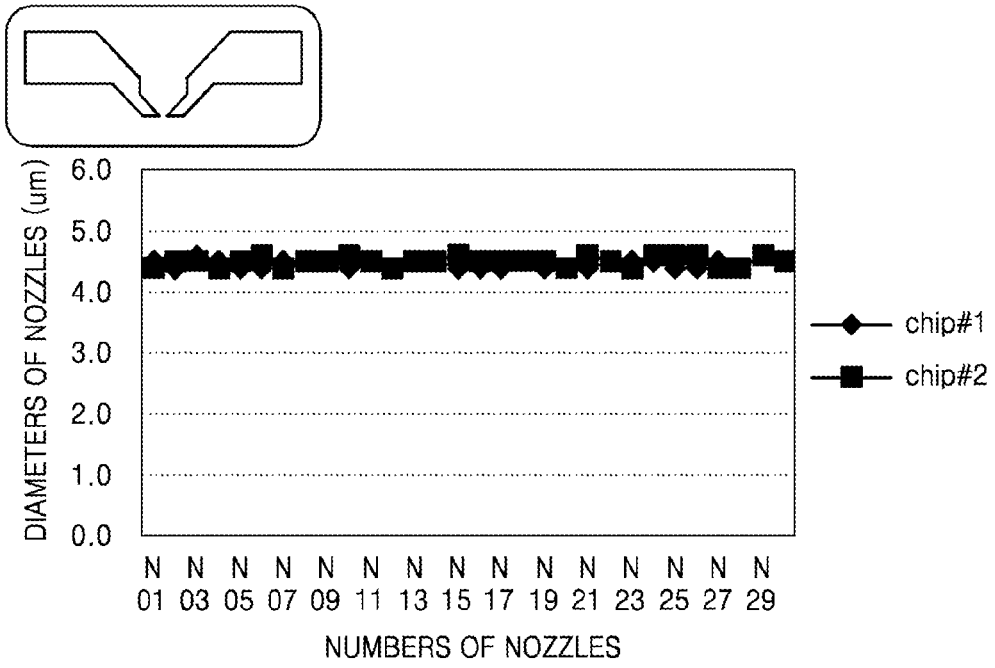
FIG. 9 is a graph illustrating a result of measuring diameters of a plurality of nozzles formed on one chip on a substrate by using the method according to at least one example embodiment.

FIG. 9 is a graph illustrating a result of measuring inner diameters NID of a plurality of nozzles 200 formed on one chip on a substrate by using the method according to at least one example embodiment. A horizontal axis indicates the number of nozzles 200 formed on the chip of the substrate. A mean value of the diameters is about 4.5 microns, a minimum value is about 4.4 microns, a maximum value is about 4.6 microns, and non-uniformity of the diameters is about 2.3%, which shows that it is possible to form nozzles with very uniform diameters relative to the example shown in FIG. 8. In other words, it shows that non-uniformity of diameters of nozzles, caused by non-uniformity of an etching process, may be reduced.

Figure 10:
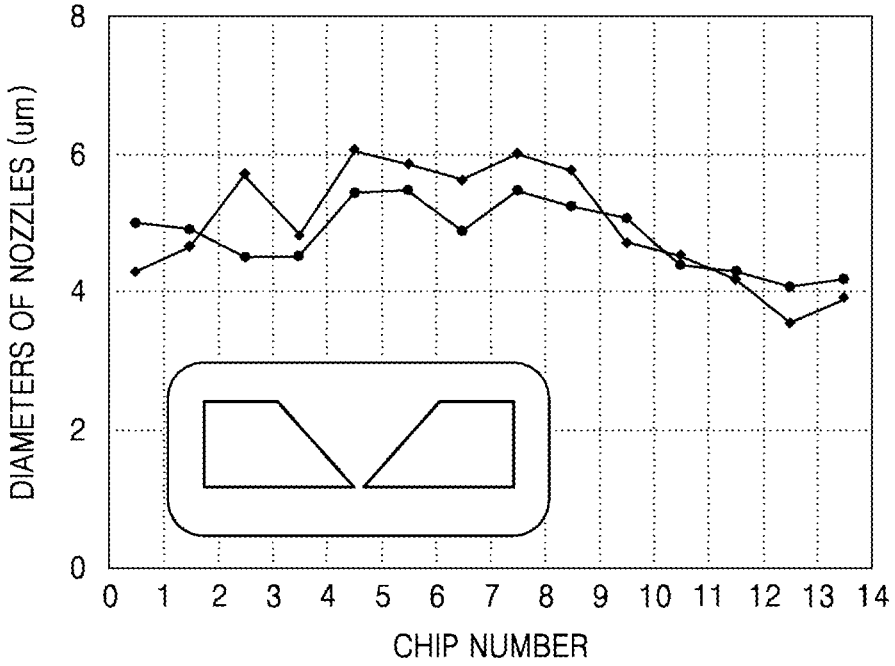
FIG. 10 is a graph illustrating a result of measuring diameters of a plurality of nozzles according to positions of chips on a substrate, the plurality of nozzles being formed in a tapered shape by penetrating the substrate by a single process.

FIG. 10 is a graph illustrating a result of measuring diameters of a plurality of nozzles according to positions of chips on a substrate, the plurality of nozzles being formed in a tapered shape by penetrating the substrate by a single process. A horizontal axis indicates the number of chips on the substrate. A mean value of the diameters is about 5.0 microns, a minimum value is about 3.8 microns, a maximum value is about 6.0 microns, and non-uniformity of the diameters is about 44%.

Figure 11:
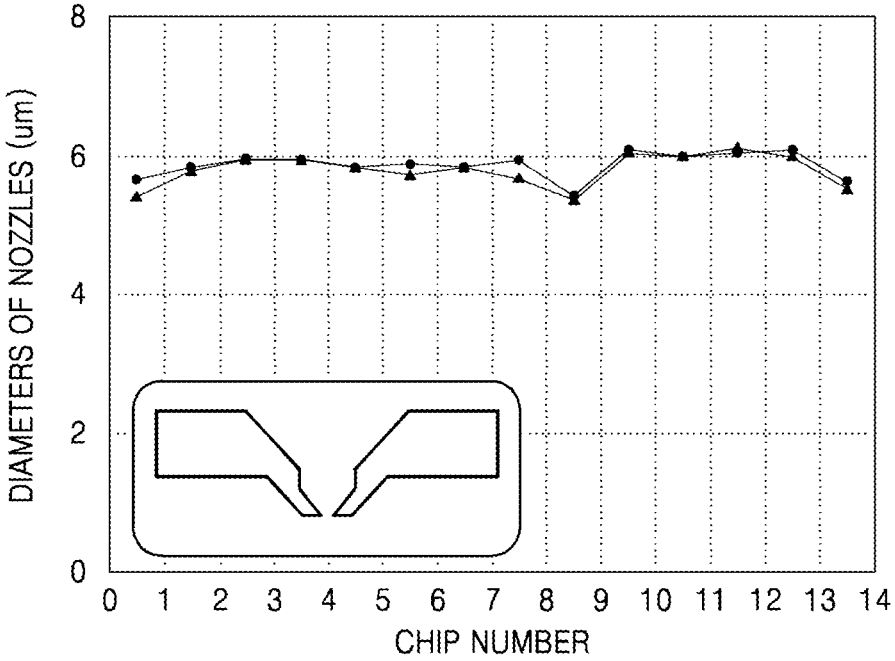
FIG. 11 is a graph illustrating a result of measuring diameters of a plurality of nozzles according to positions of chips on a substrate by using the method according to at least one example embodiment.

FIG. 11 is a graph illustrating a result of measuring inner diameters NID of a plurality of nozzles 200 according to positions of chips on a substrate by using the method according to an embodiment of the present invention. A horizontal axis indicates the number of chips on the substrate. A mean value of the diameters is about 5.8 microns, a minimum value is about 5.5 microns, a maximum value is about 6.0 microns, and non-uniformity of the diameters is about 8%, which shows that it is possible to form nozzles with very uniform diameters relative to the example shown in FIG. 10. In other words, FIG. 11 shows that non-uniformity of diameters of nozzles, caused by non-uniformity of a thickness of the substrate 300, may be reduced.

It should be understood that the exemplary embodiments described herein should be considered in a descriptive sense only and not for purposes of limitation. Descriptions of features or aspects within each example embodiment should typically be considered as available for other similar features or aspects in other example embodiments.

What is claimed is:

1. An inkjet printing apparatus comprising:

a nozzle;

wherein the nozzle includes at least two nozzle parts, a first of the at least two nozzle parts having a first tapered shape, and a second of the at least two nozzle parts having a second tapered shape and extending from the first nozzle part, wherein the first and second tapered shapes have a same taper direction, wherein the at least two nozzle parts includes a third nozzle part having a third tapered shape and extending from the second nozzle part, and wherein a taper angle of the second nozzle part is less than taper angles of the first nozzle part and the third nozzle part.

2. The apparatus of claim 1, wherein the second nozzle part has a tapered shape to a direction in which the nozzle extends, and the taper angle of the second nozzle part is greater than zero and less than 90 degrees.

3. The apparatus of claim 1, wherein the taper angles of the first nozzle part and the third nozzle part are substantially the same.

4. The apparatus of claim 1, further comprising:

a trench formed around the nozzle.

5. The apparatus of claim 1, wherein the at least two nozzle parts are in a single substrate.

6. The apparatus of claim 4, wherein the trench extends in a first direction and is formed on two sides of the nozzle in a second direction substantially orthogonal to the first direction.

7. The apparatus of claim 1, wherein the nozzle is a polypyramid shape.

8. The apparatus of claim 1, further comprising:

an actuator, wherein the actuator includes a piezoelectric actuator or an electrostatic actuator configured to provide a driving force to eject ink onto a printing medium.

9. A method of forming a nozzle of an inkjet printing apparatus, the method comprising:

forming a first depression from a first surface of a substrate, the first depression being tapered;

forming an outlet from a second surface of the substrate on an opposite side of the substrate than the first surface such that the outlet penetrates an apex of the first depression; and forming a second depression in the outlet by etching the outlet, the second depression having a taper angle different from a taper angle of the first depression.

10. A method of forming a nozzle of an inkjet printing apparatus, the method comprising:

forming a first depression from a first surface of a substrate, the first depression being tapered;

forming an outlet from a second surface of the substrate opposite to the first surface, the outlet being connected to an apex of the first depression; and forming a second depression, the second depression being formed in the outlet and having a taper angle different from a taper angle of the first depression, wherein the forming a first depression and the forming a second depression include a wet etching process.

11. The method of claim 10, wherein the forming an outlet includes a dry etching process.

12. The method of claim 10, wherein the substrate is a single crystal substrate, and wherein the wet etching process is an anisotropic wet etching process.

13. The method of claim 9, further comprising;

forming an actuator, wherein the actuator is configured to provide a driving force to eject ink onto a printing medium.

14. The method of claim 12, wherein the first depression, and the second depression are formed to have a quadrangular pyramid shape.

15. The method of claim 9, further comprising:

forming a third depression, the third depression being formed in the second depression and having a taper angle different from the taper angle of the second depression, wherein the taper angle of the second depression is less than the taper angles of the first depression and the third depression.

16. A method of forming a nozzle of an inkjet printing apparatus, the method comprising:

forming a first depression from a first surface of a substrate, the first depression being tapered;

forming an outlet from a second surface of the substrate opposite to the first surface, the outlet being connected to an apex of the first depression;

forming a second depression, the second depression being formed in the outlet and having a taper angle different from a taper angle of the first depression; and forming a third depression, the third depression being formed in the second depression and having a taper angle different from the taper angle of the second depression, wherein taper angles of the first depression and the third depression are substantially the same.

17. A method of forming a nozzle of an inkjet printing apparatus, the method comprising:

forming a first depression from a first surface of a substrate, the first depression being tapered;

forming an outlet from a second surface of the substrate opposite to the first surface, the outlet being connected to an apex of the first depression;

forming a second depression, the second depression being formed in the outlet and having a taper angle different from a taper angle of the first depression; and forming a trench around the third depression, the trench being formed in the second surface of the substrate such that the second surface is depressed toward the first surface.

18. The method of claim 17, wherein the trench is formed around an entirety of the nozzle.

19. The method of claim 17, wherein the trench extends in a first direction and is formed on two sides of the nozzle in a second direction substantially orthogonal to the first direction.

* * * * *